United States Patent [19]

Ahmed et al.

[11] 4,220,029

[45] Sep. 2, 1980

[54] CONTINUOUS EXTRUSION MACHINE AND METHOD OF CONTINUOUS EXTRUSION

[76] Inventors: Nazeer Ahmed; Myrna M. Ahmed, both of 17 Wedgewood Dr., Danbury, Conn. 06810

[21] Appl. No.: 914,798

[22] Filed: Jun. 12, 1978

[51] Int. Cl.[3] ..... B21C 23/32; B21C 33/00

[52] U.S. Cl. ..... 72/262; 72/60; 264/175; 425/376 R; 425/461; 425/363

[58] Field of Search ..... 72/60, 262; 425/363, 425/374, 366, 376 R, 461; 264/175

[56] References Cited

U.S. PATENT DOCUMENTS

| | | | |
|---|---|---|---|
| 3,881,541 | 5/1975 | Bedell | 264/175 |
| 3,922,898 | 12/1975 | Voorhes | 72/262 |
| 3,934,446 | 1/1976 | Avitzur | 72/262 |
| 3,985,011 | 10/1976 | Fuchs, Jr. | 72/60 |
| 4,041,595 | 8/1977 | Voorhes | 72/262 |
| 4,094,178 | 6/1978 | Fuchs, Jr. | 72/60 |
| 4,177,658 | 12/1979 | Ahmed et al. | 72/60 |

FOREIGN PATENT DOCUMENTS

| | | | |
|---|---|---|---|
| 447208 | 12/1975 | U.S.S.R. | 72/199 |

*Primary Examiner*—Lowell A. Larson

[57] ABSTRACT

A method, apparatus and process for forming an elongated product of unlimited length is disclosed. The method consists of gripping and feeding a material of unlimited length between two toruses whose toroidal surfaces have suitable shaped grooves to accommodate the incoming material. The toruses are so constructed that each of them can sustain a radial deformation substantially in excess of 0.2 per cent without undergoing a permanent plastic set. The toroidal surfaces of the two toruses are radially squeezed against each other so as to cause a temporary radial deformation in both toruses substantially in excess of 0.2 per cent but less than an amount that causes a permanent set in either torus. This creates a contact length between the two toruses. Such squeezing also causes a three dimensional stress distribution in the grooves which stress is substantially hydrostatic. A deformation control element with a suitably shaped aperture or apertures is located substantially in the center of the length of contact. The incoming material is gripped between the two toroidal surfaces and is pushed into the die by rotating the two toruses together so that the toroidal surfaces in contact move linearly at substantially identical velocities and so that there is substantially no slippage between the toroidal contact surfaces and the incoming rod and such that there is substantially no upset or work hardening in the incoming material before it enters the die. In the deformation control element, which is the die, the incoming material undergoes suitable deformation. The product exiting from the die is of unlimited length and is of a shape and size which is determined by the shape and size of the orifice or orifices in the die.

9 Claims, 7 Drawing Figures

CONTINUOUS EXTRUSION MACHINE AND METHOD OF CONTINUOUS EXTRUSION

FIELD OF THE INVENTION

This invention relates to the extrusion of materials of unlimited length. More particularly, it relates to an extrusion machine the basic elements of which are two toruses which are pressed against each other radially so that the maximum radial deformation in each of them is substantially greater than 0.2 percent but less than an amount that causes permanent set in either of them. Each torus has a suitable shaped groove on its toroidal surface. A die supported by a die stem is located near the center of the contact length. The material to be extruded is gripped between the toroidal surfaces and is fed towards the die by rotating together the toruses. A product of unlimited length is thus extruded.

DESCRIPTION OF THE PRIOR ART

Methods of continuously extruding materials of unlimited length are known. In U.S. Pat. No. 3,985,011 granted to F. J. Fuchs, Jr., a method of continuously extruding a material of unlimited length is described. In this method a continuously moving high pressure chamber is built up of a plurality of segments which are driven past a stationary die. The segments ride on tracks. Each segment has gear teeth on its outer surface which mesh with drive gears. As the segments approach each other they form a continuously moving chamber. The coupling between the moving chamber and the input material is provided by the shear strength of a viscous fluid a layer of which is smeared on the input material before it enters the machine. The tendency of the segments to open outwards is prevented by the provision of suitable support pads. In U.S. Pat. Nos. 3,765,216 and 3,872,703 granted to D. Green a continuous extrusion machine is constructed of a rotating drum which has a circumferential groove. A portion of the periphery of the drum is covered by a stationary shoe which accommodates a die. As the drum is rotated the material to be extruded is fed into the circumferential groove between the rotating drum and the stationary shoe. The groove is so shaped that the drive friction between the drum and the work piece is greater than the retarding friction between the stationary shoe and the workpiece. The material is thus pushed into the die where extrusion takes place.

The disadvantage of the method and apparatus disclosed by D. Green in U.S. Pat. No. 3,765,216 is that drive friction is applied only over a portion of the material to be extruded. The retarding friction generates heat which heats up the incoming material and lowers the overall efficiency of extrusion. The disadvantage of the method and apparatus disclosed by F. J. Fuchs, Jr., in U.S. Pat. No. 3,985,011 is that it requires the moving segments to be supported both longitudinally and radially. Since extrusion takes place in a chamber built up of a series of travelling segments, the outward tendency of the segments to open up is suppressed by applying a suitable counterforce through stationary pressure pads. The contact under high pressure between the moving elements and the stationary element puts a heavy demand on the strength and wear capability of both. Furthermore, in the design aforementioned, the tendency of the segments to open up longitudinally is suppressed by supplying a suitable longitudinal squeeze force to the segments.

In U.S. Pat. No. 3,934,446 granted to Avitzur, an incoming rod of material is gripped and upset by two roller means and the upset rod is fed into a stationary die where extrusion takes place. The disadvantage of this method is that the upsetting of the incoming rod work hardens the rod material and this in turn increases the extrusion pressure. Furthermore, contact lengths in this method are relatively small. In U.S. Pat. No. 3,922,898 granted to Voorhees the feedstock is gripped on two opposing surfaces and fed into a stationary die while on the other two surfaces the feedstock is subjected to an opposing force. The feedstock material upsets before it reaches the die. The disadvantages of this technique are that the opposing friction on two surfaces of the feedstock reduces the overall work efficiency of the machine and the upset feedstock work hardens causing the extrusion pressure to increase. In U.S. Pat. No. 4,041,595 granted to Voorhees, the incoming material is gripped and upset by two moving means on two opposite sides while the motion of the material is opposed on two other sides by the friction between the material and a fork shaped element. In this method also, the upsetting of the feedstock causes work hardening of the material and increases extrusion pressure. Also, the opposing friction of the fork shaped member reduces overall work efficiency.

In U.S. Pat. No. 4,094,178 granted to Fuchs two eccentrically placed rotors cooperate to advance the feedstock into a stationary die. The disadvantage of this method is that the eccentricity of the rotors subjects a portion of the feedstock to lateral shear. Frictional heat is thereby put into the feedstock and the overall extrusion machine efficiency suffers.

It is therefore advantageous to provide an extrusion machine which overcomes the aforementioned disadvantages of previous inventions.

OBJECTIVES OF THIS INVENTION

The objectives of this invention are:

(a) To provide an extrusion machine in which drive tractions are applied over the entire periphery of the incoming material in such a manner that there is substantially no slippage, longitudinal or lateral, between the incoming material and the traction applying travelling chamber and such that the feedstock is continuously fed into a stationery die with substantially no upset and no work hardening before it enters the die;

(b) To provide an extrusion machine where a state of hydrostatic stress is substantially achieved in the traction applying surfaces due to the shape and the nature of deformation of these surfaces;

(c) To provide an extrusion machine using which an elongated product of unlimited length may be formed;

(d) To provide a method and process of continuous extrusion of a product of unlimited length in which drive tractions are applied over the entire surface of the incoming material so that there is substantially no upset and no work hardening of the material before it reaches the die and so that there is substantially no slippage between the workpiece and the drive surfaces and so that a state of hydrostatic stress is achieved in the drive surfaces due to their shape and the nature of their deformation.

SUMMARY OF THE INVENTION

The invention contemplates a machine and a process whereby a material of unlimited length is continuously extruded. Two toruses are squeezed against each other radially by suitable means so as to cause a temporary maximum radial deformation in each of them of a magnitude greater than 0.2 percent but less than an amount that causes a permanent set in either torus. Suitable shaped grooves are provided along the periphery of the toroidal surfaces. A stationary die supported by a die stem is located near the center of the length of contact. A material of unlimited length is fed between the two toruses into the chamber formed by the grooves and is pushed along the length of contact by rotating the toruses so that there is substantially no upset or work hardening in the material. A suitable lubricant may be applied to the incoming rod for traction control. The push in the incoming rod is generated by the traction between the rotating toroids and the rod. Due to this push the incoming material is extruded through the die into a shape and size determined by the shape and size of the orifice in the die. The toroidal shape ensures that the stresses near the groove are substantially hydrostatic thereby enabling extrusion at pressures that are higher than the yield stress in simple tension of the torus material.

THE DRAWINGS

FIG. 1 shows two toruses squeezed against each other radially. The nature of contact stress distribution between them at the surface of contact is shown by the arcuate line. The temporary deformation of each torus is substantially greater than 0.2 percent but is less than an amount that causes a permanent set in either torus.

Figure 4:
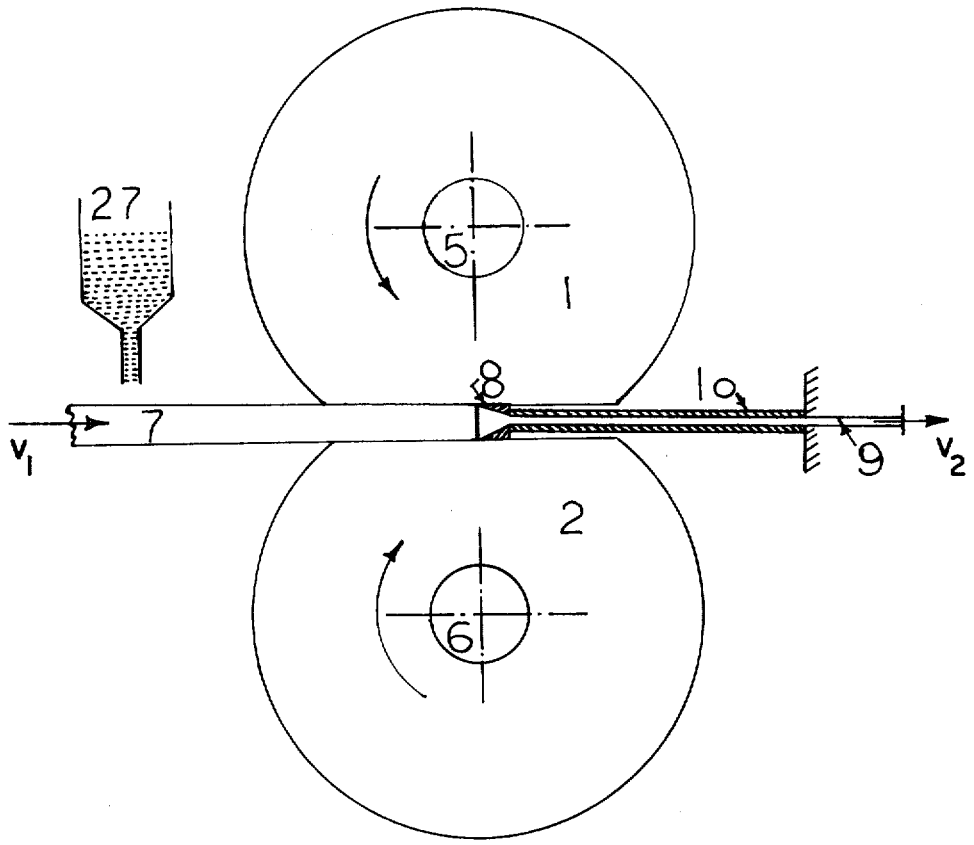

FIG. 4 shows a deformation control element, such as a die, located substantially near the center of the length of contact. It also shows an incoming rod of indefinite length and an outgoing product of indefinite length. The velocity of the exiting product $V_2$ is greater than the velocity of the incoming rod $V_1$.

Figure 5:
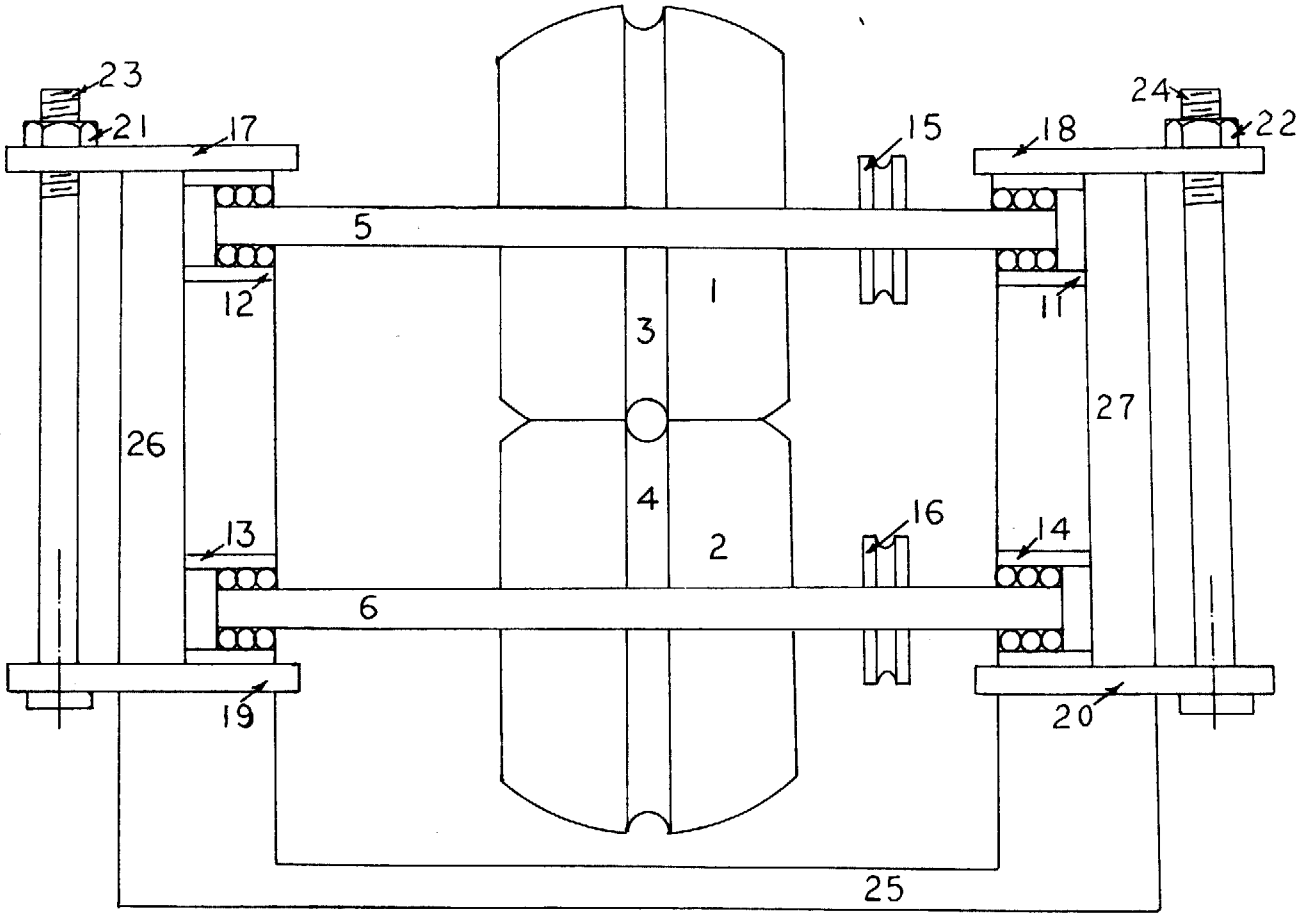

FIG. 5 shows a schematic of a continuous hydrostatic machine such as envisaged in the present invention.

Figure 6:
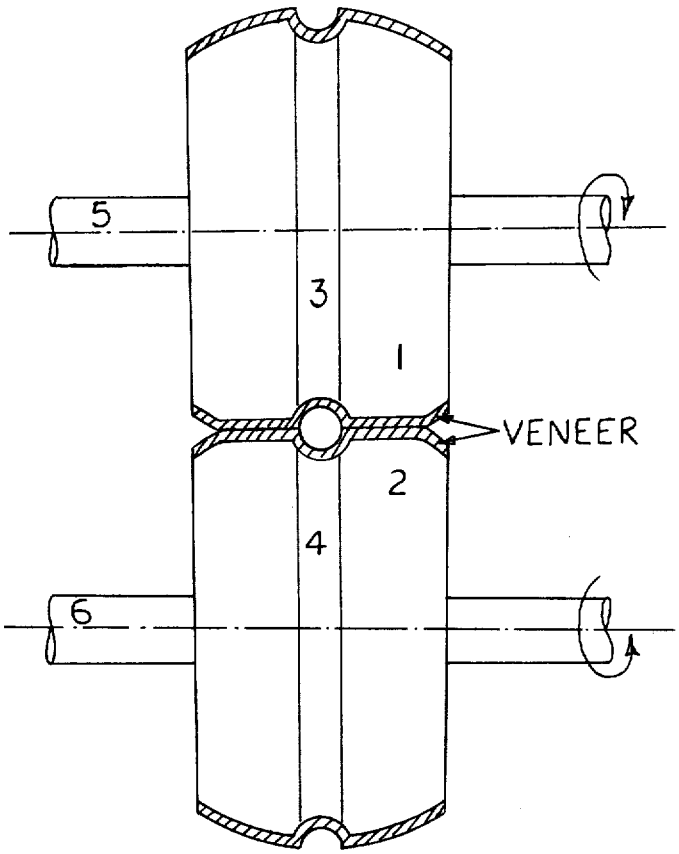

FIG. 6 shows a construction of the two toroids incorporating an outer veneer of a hard material around a core of a softer material.

Figure 7:
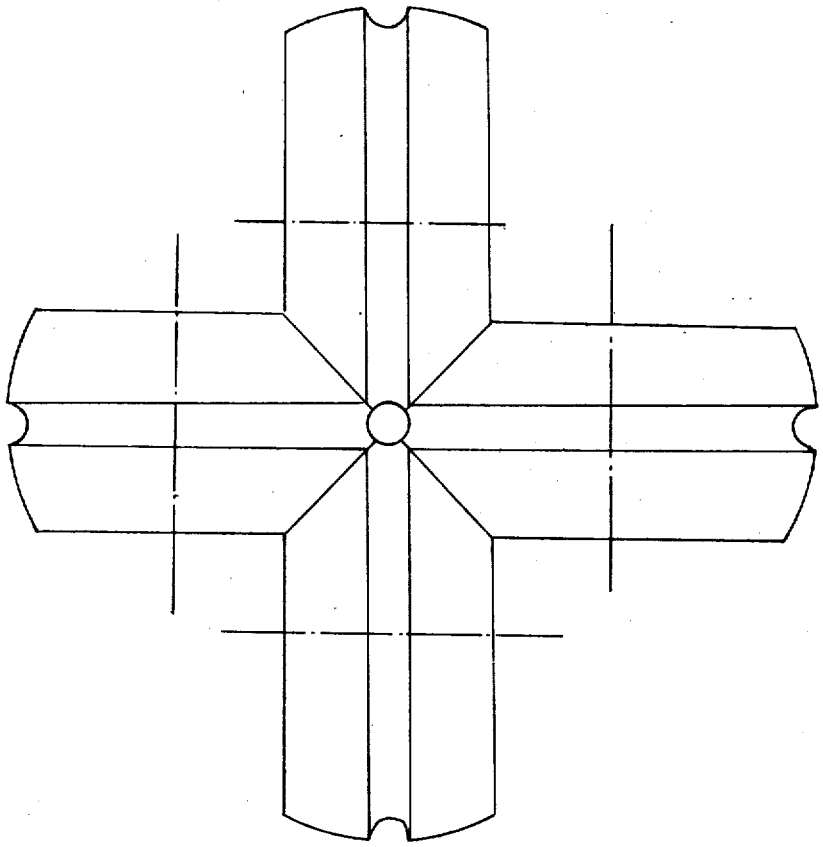

FIG. 7 shows four toroidal quadrants squeezed together to form a high pressure chamber.

DETAILED DESCRIPTION

Figure 1:
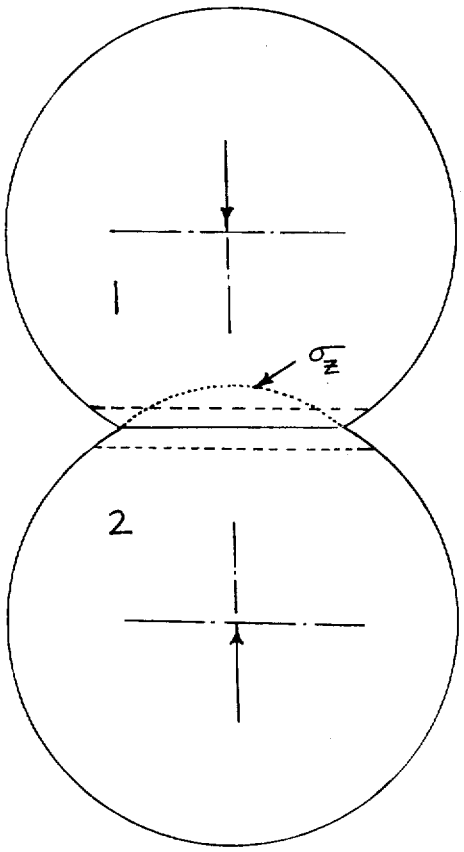

Consider FIG. 1. It shows two toruses 1 and 2 in contact. The nature of stress distribution between two spherical bodies in contact has been worked out in *Theory of Elasticity* by Timoshenko and Goodier, McGraw-Hill Book Company, Second Edition, page 372. It shows that the greatest principal stress is compressive and is at the midpoint of the length of contact and this is the stress normal to the plane of contact. The nature of this principal stress is shown by the arcuate line $\sigma_z$ in FIG. 1. The other two principal stresses at the same point are shown by Timoshenko and Goodier to be $\sigma_r=\sigma_\theta=\sigma_z 1+2\upsilon/2$, where $\upsilon$ is the Poisson's ratio of the torus material. It is seen that if the toruses are constructed of a material which has a Poisson's ratio in the vicinity of 0.5 the other two principal stresses $\sigma_z$ and $\sigma_\theta$ will be substantially the same as the stress $\sigma_z$. Rubbers and plastics are substantially incompressible materials and they have a Poisson's ratio in the vicinity of 0.5. If the toruses are constructed of such materials then the state of stress at the points of contact will be substantially hydrostatic. Hence the maximum shearing stress on which yielding of such materials may depend will be negligible. These materials may thus sustain a contact stress much higher than their yield stress in simple tension or compression. Even with materials such as steel which has a Poisson's ratio of approximately 0.3 the stresses $\sigma_r$ and $\sigma_\theta$ are approximately 80 percent of the stress $\sigma_z$. The shearing stresses which are equal to half the difference between the maximum and minimum principal stresses are small and a high contact stress can thus be sustained.

Figure 2:
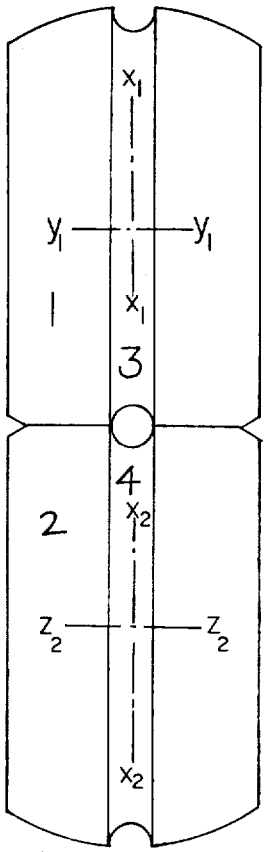
FIG. 2 is an end view of FIG. 1 and it shows the grooves on the periphery of the toruses. The groove in each torus sits astride a diametral plane which is perpendicular to the axis of rotation of the respective torus.
Figure 3:
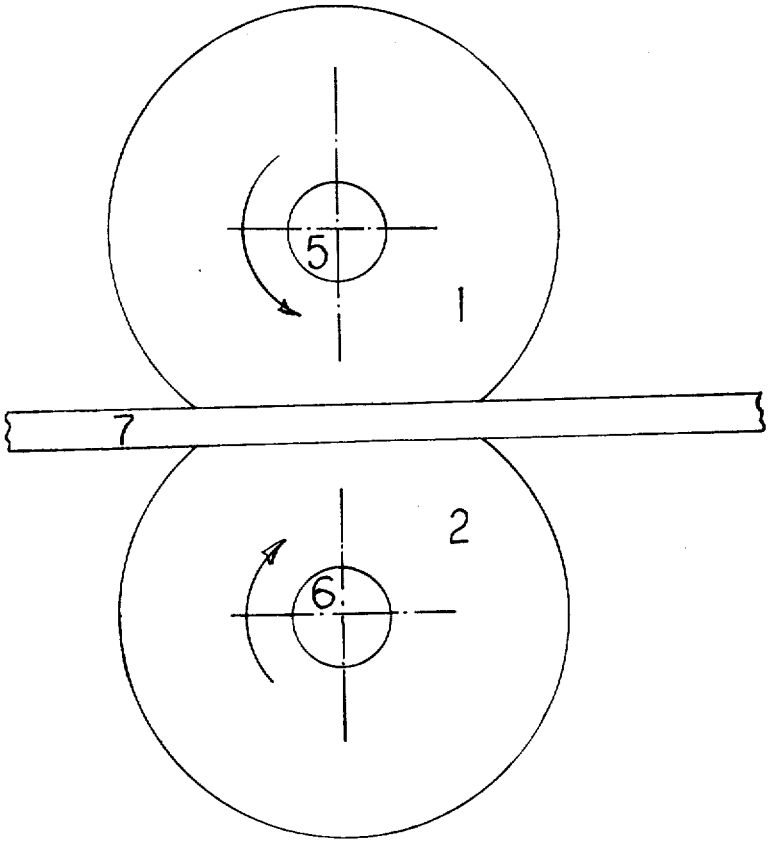
FIG. 3 shows a rod being pushed by the rotating action of two toroids which are pressed radially against each other.

Extrusion refers to a process in which a material is pushed under compressive stresses through a deformation control element such as a die to form an elongated product. Continuous extrusion refers to an extrusion process where such deformation is carried out on a product of unlimited length. Consider FIG. 2. In this figure the toruses 1 and 2 are shown with peripheral grooves 3 and 4. Groove 3 sits astride a diametral plane $x_1x_1$ which is perpendicular to the axis of rotation $y_1y_1$ of torus 1. Groove 4 sits astride a diametral plane $x_2x_2$ which is perpendicular to the axis of rotation $z_2z_2$ of torus 2. The toruses are squeezed radially against each other so that planes $x_1x_1$ and $x_2x_2$ coincide, the axes $y_1y_1$ and $z_2z_2$ are parallel and the grooves 3 and 4 cooperate to form a high pressure chamber. As shown in FIG. 3 a rod 7 is fed into the contact area between the toroids and the toroids are rotated in the appropriate direction by rotating the shafts 5 and 6 on which the toroids are mounted. In FIG. 4 The rod 7 is pushed forward due to the traction between the toroids 1 and 2 and the incoming rod 7. The shear stress between the moving toruses and the incoming rod which is responsible for pushing the rod forward is given by Coulomb friction $$\tau(\text{tau})=\sigma_z\mu$$

where $\mu$ is the coefficient of friction between the toruses and the rod and $\sigma_z$ is the normal stress. Due to this shear stress, an axial compressive stress is generated in the incoming rod. If A is the area of cross section of the incoming rod, s the length of its perimeter, the incremental axial stress $\Delta\sigma_c$ along an incremental length $\Delta x$ is given by force balance $$\Delta\sigma_c=s\tau\Delta x/A$$

It is seen that the distribution of axial stress in the incoming rod is similar to that of the shear stress along its periphery. The total force tending to push the rod along a length L is determined by integrating $\Delta\sigma_c$ along its length:

$$\sigma_c=\int s\tau\Delta x/A$$

It is this force $\sigma_c$ that provides the necessary push for the incoming rod in its axial direction.

In FIG. 4 is shown a die 8 located approximately halfway along the length of contact between the two toruses 1 and 2. The die is supported by a die stem 10. A rod of unlimited length 7 is shown being pushed into the die to form a product 9 of unlimited length. The necessary push for the incoming rod is provided by the traction between the rotating toruses 1 and 2 and the rod. There is no slippage between the rod 7 and the toroids 1 and 2. The rod 7 is held between and pushed forward by the rotating toruses so that there is substantially no upset in the rod 7 and the rod 7 arrives at the die with substantially no work hardening. The incoming rod may be of any suitable shape consistent with the shape of the grooves in the toruses. The shape and size of the elongated product as it comes out of the die is dictated by the shape of the orifice or orifices in the die. The material that is being extruded may be metallic or non-metallic. In order to control the traction between the extruding material and the toroids a suitable lubricant may be applied to the incoming material 7 before it enters the region of contact between the toruses. Such a lubricant applicator is shown at designation 27 in FIG. 4. However, the extrusion may be carried out with no llubrication if preferred.

FIG. 5 shows a continuous hydrostatic extrusion machine as embodied in this invention. The toruses 1 and 2 are mounted on shafts 5 and 6. Shaft 5 is supported in roller thrust bearings 11 and 12. Shaft 6 is supported in roller thrust bearings 13 and 14. The shafts are driven by belt driven pulleys 15 and 16. In order to apply radial squeeze on the toruses, suitable squeeze plates are provided. In FIG. 5 squeeze plate 17 acts on bearing 12, squeeze plate 18 on bearing 11, squeeze plate 19 on bearing 13, and squeeze plate 20 on bearing 14. The bearings and hence the toruses mounted on shafts are squeezed together by tightening the nuts 21 and 22 on squeeze bolts 23 and 24. In order to prevent lateral wobbling as the toroids rotate together the bearings are mounted in a frame 25 which has vertical arms 26 and 27 with machined guide slots for the bearings.

As shown in FIG. 4 a deformation control element such as a die is located near the center of contact length. The die is supported by a die stem 10.

As the toruses 1 and 2 are rotated by rotating the pulleys 15 and 16 by the action of drive belts, an elongated material of unlimited length is fed into the contact area between the two toroids. It should be noted that in this machine there is substantially no longitudinal or lateral slippage between the rotating toruses 1 and 2 and the incoming rod 7. Also, there is substantially no upset and no work hardening in the material before it arrives at the die. Due to the traction between the incoming material and the toroids the incoming material 7 is pushed into the die where deformation takes place. An elongated product 9 of unlimited length exits from the die and may be taken up by a spool.

The description provided here is for a preferred embodiment of this invention. Variations are possible on this design which would not alter the basic nature of this continuous extrusion machine or the method of using it to produce an elongated product of unlimited length. For instance, instead of using only two toroids it may be possible to use four toroids as shown in FIG. 7. These four toroids are squeezed together in a manner similar to those described for two toroids. The nature of contact stresses and squeeze force is similar. Also similar is the nature of extrusion.

In certain applications it may be necessary to use a layered construction for the toruses as shown in FIG. 6. For instance, in extruding a hard material it may be desirable to have a thin veneer of hard metallic material on a core of a soft material in the construction of the toruses. The present invention also embodies such layered construction.

As an example, if a continuous hydrostatic extrusion machine as disclosed in this invention is contemplated for the extrusion of lead or tin or solder through a reduction of 50 percent, it is sufficient to build the two toruses of cast nylon. Each torus may be 15 inches in diameter and the toruses may be squeezed radially against each other so as to cause a temporary maximum radial deformation of 4 percent.

As another example, if the hydrostatic extrusion of copper or aluminum or gold or silver is contemplated through a reduction of 50%, then the toruses are of a layered construction. Each torus is 18 inches in diameter. It is made of a core of cast nylon with a thin circumferential veneer of hard coated stainless steel 0.020 to 0.25 inches thick. The layered toruses are squeezed radially against each other so as to cause a temporary maximum radial deformation of 4 percent.

We claim:

1. An apparauts for the extrusion of an elongated material of unlimited length into an elongated product of unlimited length which apparatus consists of:

(a) a first torus which has a peripheral groove located astride a diametral plane perpendicular to its axis of rotation and a second torus which has a peripheral groove located astride a diametral plane perpendicular to its axis of rotation, said grooves so constructed that when the first and second toruses are radially squeezed against each other the peripheral grooves cooperate to form a high pressure chamber;

(b) the said toruses so constructed that each of them can sustain a maximum radial deformation in excess of 0.2 percent without undergoing a permanent set;

(c) the said toruses mounted on shafts so that the axis of each shaft is coincident with the axis of rotation of the respective torus it supports;

(d) the said shafts housed in bearings located in a frame such that the shafts can rotate on axes parallel to each other;

(e) squeeze plate means for applying pressure on said bearings so that the two toruses are radially squeezed against each other such that each torus is subjected to a maximum temporary radial deformation which is substantially in excess of 0.2 percent but less than an amount that causes a permanent set in either torus;

(f) a stationary die supported by a die stem and located substantially near the center of contact length formed between the said toruses;

(g) motor means for rotating the said toruses so that the contact surfaces of the toruses move linearly together along the contact length and the high pressure chambers formed by the peripheral grooves which grips and pushes a suitably shaped incoming rod of unlimited length into the stationary die in such a manner that there is substantially no slippage between the incoming rod and the high pressure chamber and such that the incoming rod material suffers substantially no upset or work hardening before it enters the die wherein deformation takes place and the product exits from the die at a velocity greater than that of the incoming rod.

2. The apparatus as described in claim 1 wherein said toruses are of a layered construction with an outer layer surrounding an inner core such that the stiffness of the outer layer material is different from the stiffness of the core material.

3. The apparatus as described in claim 1 wherein said toruses are of a layered construction, each layer consisting of a different material from the one adjacent to it.

4. A method of continuous extrusion where a material of unlimited length is extruded by pushing it through a suitably supported stationary die located near the center of contact length formed by radially squeezing together two toruses each of which has a suitably shaped circumferential groove located astride a diametral plane perpendicular to the axis of rotation of the respective torus so that when the toruses are radially squeezed against each other the grooves cooperate to form a high pressure chamber such squeezing to be of magnitude sufficient to cause a temporary radial deformation in each torus of at least 0.2 percent but less than an amount that upsets either torus, rotating the two toruses together and feeding into said high pressure chamber the incoming material of a shape and size corresponding to the shape and size of the high pressure chamber so that the traction between the rotating toruses and the incoming material pushes it into the stationary die with substantially no upset or work hardening in the material before it reaches the die and no substantial longitudinal or lateral slippage between the rotating toruses and the incoming material and causes the material to extrude into a shape and size determined by the shape and size of orifice or orifices located in the die, after which the extruded product of unlimited length is taken up on a spool.

5. The method as described in claim 4 wherein said toruses are of a layered construction with an outer layer surrounding an inner core such that the stiffness of the outer layer material is different from the stiffness of the core material.

6. The method as recited in claim 4 wherein said toruses are of a layered construction, each layer consisting of a different material from the one adjacent to it.

7. A process of forming an elongated product of unlimited length from a rod of unlimited length which process consists of:

(a) squeezing radially a first torus which has a peripheral groove located astride a diametral plane perpendicular to the axis of rotation of the first torus against a second torus which has a peripheral groove located astride a diametral plane perpendicular to the axis of rotation of the second torus such that each torus is subjected to a maximum temporary radial deformation of a magnitude greater than 0.2 percent but less than an amount that causes a permanent radial deformation in either torus and such that the peripheral grooves cooperate to form a high pressure chamber along the length of contact of the said toruses;

(b) locating a suitable deformation control element such as a die supported on a die stem substantially near the center of the length of contact;

(c) feeding a material of unlimited length into the chamber formed by the grooves on the periphery of said toruses;

(d) rotating the two toruses so as to cause the incoming material to be pushed into the deformation control element with substantially no upset or work hardening before it reaches the die and with no slippage between the incoming material and the rotating toruses so that the incoming material is formed into a product of unlimited length in the deformation control element and the formed product exits from the deformation control element at a velocity greater than that of the incoming material;

(e) applying a suitable lubricant on the incoming material so as to control the traction between the rotating toruses and the incoming rod;

(f) taking up the extruded product of unlimited length on a spool.

8. The process as recited in claim 7 wherein said toruses are of a layered construction with an outer layer surrounding an inner core such that the stiffness of the outer layer material is different from the stiffness of the core material.

9. The process as recited in claim 7 wherein said toruses are of a layered construction each layer consisting of a different material from the one adjacent to it.

* * * * *